US005767831A

United States Patent [19]

Onishi et al.

[11] Patent Number: 5,767,831

[45] Date of Patent: Jun. 16, 1998

[54] DOT-MATRIX DISPLAY FOR SCREEN HAVING MULTIPLE PORTIONS

[75] Inventors: Kazumasa Onishi, Saitama-ken; Hideaki Fujimori, Tokyo, both of Japan

[73] Assignee: Sanyo Electric Co., Ltd., Moriguchi, Japan

[21] Appl. No.: 979,160

[22] Filed: Nov. 23, 1992

[30] Foreign Application Priority Data

Nov. 22, 1991 [JP] Japan ..... 3-307811

[51] Int. Cl.[6] ..... G09G 3/36

[52] U.S. Cl. ..... 345/103

[58] Field of Search ..... 345/98, 100, 103, 345/190, 189, 203, 200

[56] References Cited

U.S. PATENT DOCUMENTS

| | | | |
|---|---|---|---|
| 4,346,378 | 8/1982 | Shanks | 345/98 |
| 4,985,698 | 1/1991 | Mano et al. | 345/103 |
| 5,387,923 | 2/1995 | Mattison et al. | 345/103 |

*Primary Examiner*—Jeffery Brier
*Attorney, Agent, or Firm*—Darby & Darby

[57] ABSTRACT

A dot-matrix display apparatus includes an address conversion/switch circuit which converts a system address of 16 bits outputted from a CPU into a write address in a manner that a most significant bit of the system address becomes a least significant bit of the write address and remaining bits of the system address are shifted upward one by one bit so as to become remaining bits of the write address. The upper 8 bits of the write address becomes a Y address for designating a row of a VRAM and the lower 8 bits of the write address becomes an X address for designating a column of the VRAM. Display data are written in the VRAM in a manner that display data for an upper half of a screen of an LCD and display data for a lower half thereof are in a row one after the other. When the display data are read from the VRAM in accordance with read addresses from a display address generating circuit, the display data are outputted in a manner that the display data for the screen upper half and the display data for the screen lower half are in a row one after the other. Therefore, on the screen of the LCD, images are displayed simultaneously on the upper half and the lower half.

5 Claims, 4 Drawing Sheets

DOT-MATRIX DISPLAY FOR SCREEN HAVING MULTIPLE PORTIONS

BACKGROUND OF THE INVENTION

1. Field of the Invention

The present invention generally relates to a dot-matrix display apparatus. More specifically, the present invention relates to a dot-matrix display apparatus such as a liquid crystal display, EL display, plasma display or the like for a large screen display which is used for a lap-top work station and required for high precision and high resolution.

2. Description of the Prior Art

A display apparatus in which an image is displayed on a CRT by utilizing a dual-port memory as a display memory (hereinafter, called as "VRAM") is known. In such prior art, in a system mode, display data is written in the VRAM by using the upper 8 bits of system addresses and the lower 8 bits thereof as Y addresses for designating rows of the VRAM and X addresses for designating columns of the VRAM, respectively. Then, in a display mode, in accordance with addresses that are synchronous with display timings of the CRT, the display data for respective horizontal lines are read-out in a bit-parallel fashion from the VRAM, and the display data are converted into bit serial data via a data latch so as to be applied to a CRT circuit.

It is impossible to use the prior art for a high-precision dot-matrix display apparatus such as a liquid crystal display because the number of dots of such a display must be large for a high precision display. More specifically, if the display has a large number of dots in order to make a display duty for each dot large, an arrangement in which a screen is divided into an upper half and a lower half and the both halves are driven simultaneously becomes necessary. However, the structure of the prior art in which a system address space and a display address space are coincident with each other cannot be embodied in such the contrivance.

It can be considered that a capacity of the VRAM is doubled and the display data for the upper half and the lower half are simultaneously outputted; however, in such an arrangement, the cost becomes high.

SUMMARY OF THE INVENTION

Therefore, a principal object of the present invention is to provide a novel dot-matrix display apparatus.

Another object of the present invention is to provide a dot-matrix display apparatus in which divided screen portions can be simultaneously driven with no increase of cost.

A dot-matrix apparatus in accordance with the present invention comprises: means for generating display data; means for generating system addresses each being 2n bits; address converting means for converting the system addresses into write addresses in a manner that the most significant one or more i bits of each of the system addresses become the least significant one or more i bits of each of write addresses and remaining bits of each of the system addresses are sequentially shifted upward so as to become remaining bits of the each of the write addresses; a display memory to which the display data are written according to Y addresses that are respective upper n bits of the write addresses and X addresses that are respective lower n bits of the write addresses; display address generating means for generating display addresses each being 2n bits in which respective upper n bits and respective lower n bits are used as the Y addresses and the X addresses, respectively, so as to read-out the display data from the display memory in an address sequential order. The apparatus has dot-matrix display means which divides a display screen into a plurality of screen portions in one of either the horizontal or vertical directions for simultaneously displaying images according to the display data on the screen portions.

In the present invention, the address converting means converts the system addresses from a CPU into the write addresses for writing the display data in the VRAM in a manner that the most significant i bits are made as the least significant bits and remaining bits are shifted one by one bit upward. VRAM addresses are formed by using the respective upper n bits and respective lower n bits of the write addresses, that is, the Y addresses and the X addresses. If the screen is divided into an upper half screen portion and a lower half screen portion, the Y address designates the upper half screen portion when the most significant bit of the system address that has not been converted is "0", and the lower half screen portion when the most significant bit of the system address that has not been converted is "1". Therefore, if the display data are written in the VRAM in accordance with the X addresses and the Y addresses both obtained in the above described manner, the display data for respective halves are written in the VRAM to be in a row one after the other. Then, the display data written into the VRAM are read-out in accordance with the read addresses in a bit-parallel fashion one by one row. Therefore, if the display data are outputted in a bit-sequential manner via a latch, for example, on the screen of the dot-matrix display such as an LCD, images are simultaneously displayed on the upper half screen portion and the lower half screen portion.

In accordance with the present invention, only by converting the system addresses into the write addresses for writing the display data in the VRAM by means of the address converting means, it is possible to simultaneously drive a plurality of screen portions with no increase of cost. Therefore, even if a high-precision dot-matrix display is constituted, it is possible to secure a necessary display duty for each dot.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1A:
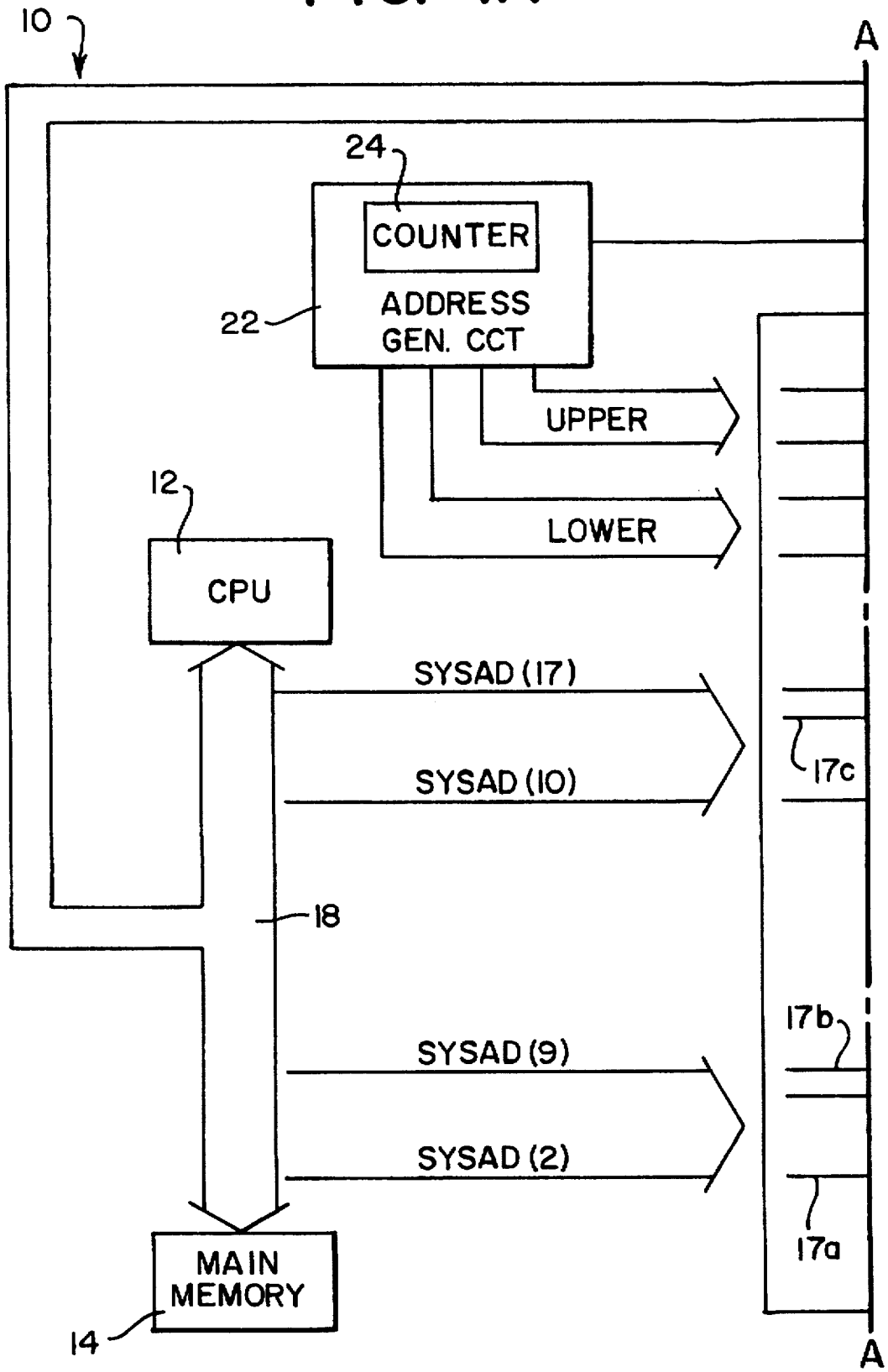
FIGS. 1A, 1B and 1C are a block diagram showing one embodiment according to the present invention.
Figure 1B:
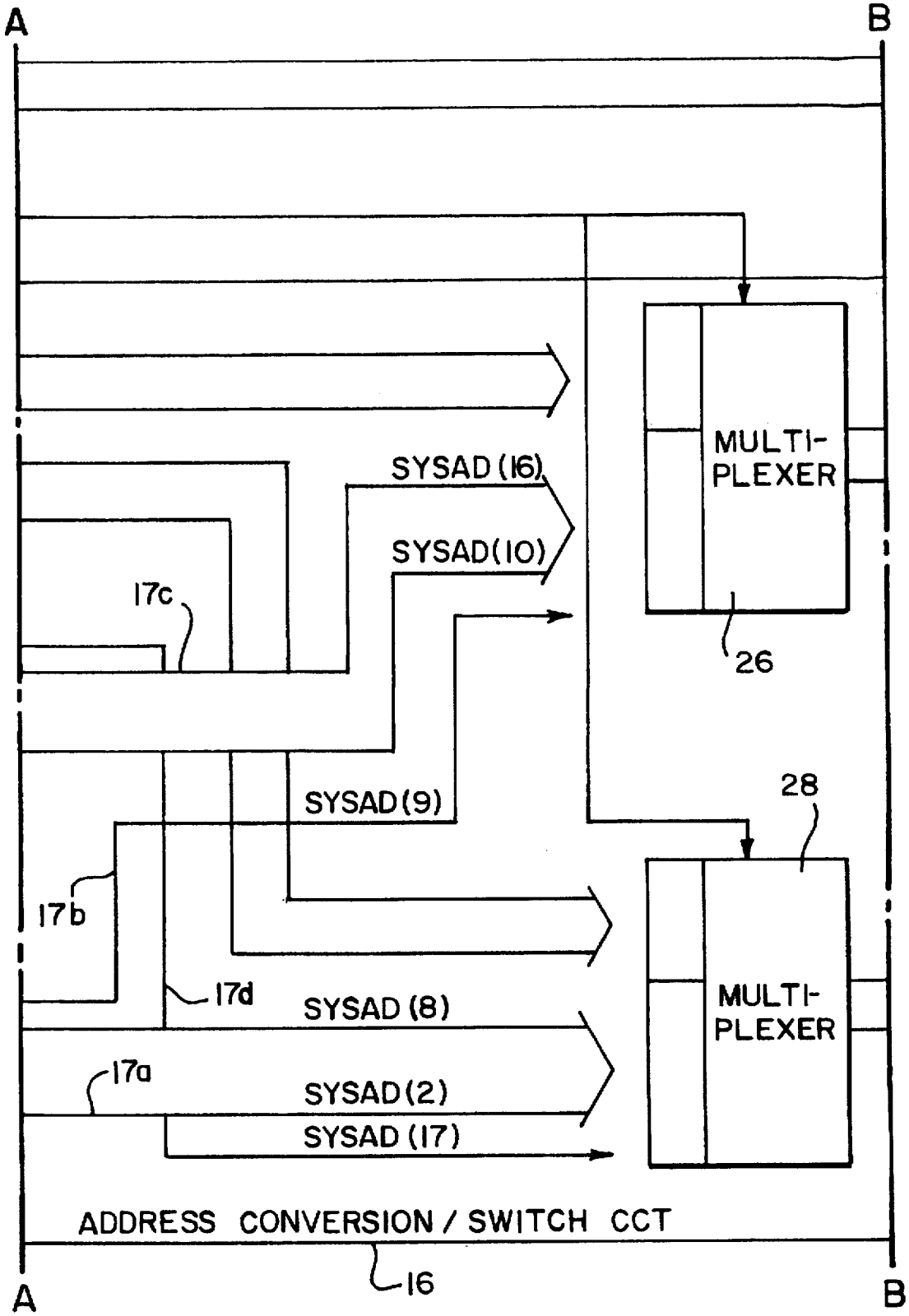
Figure 1C:
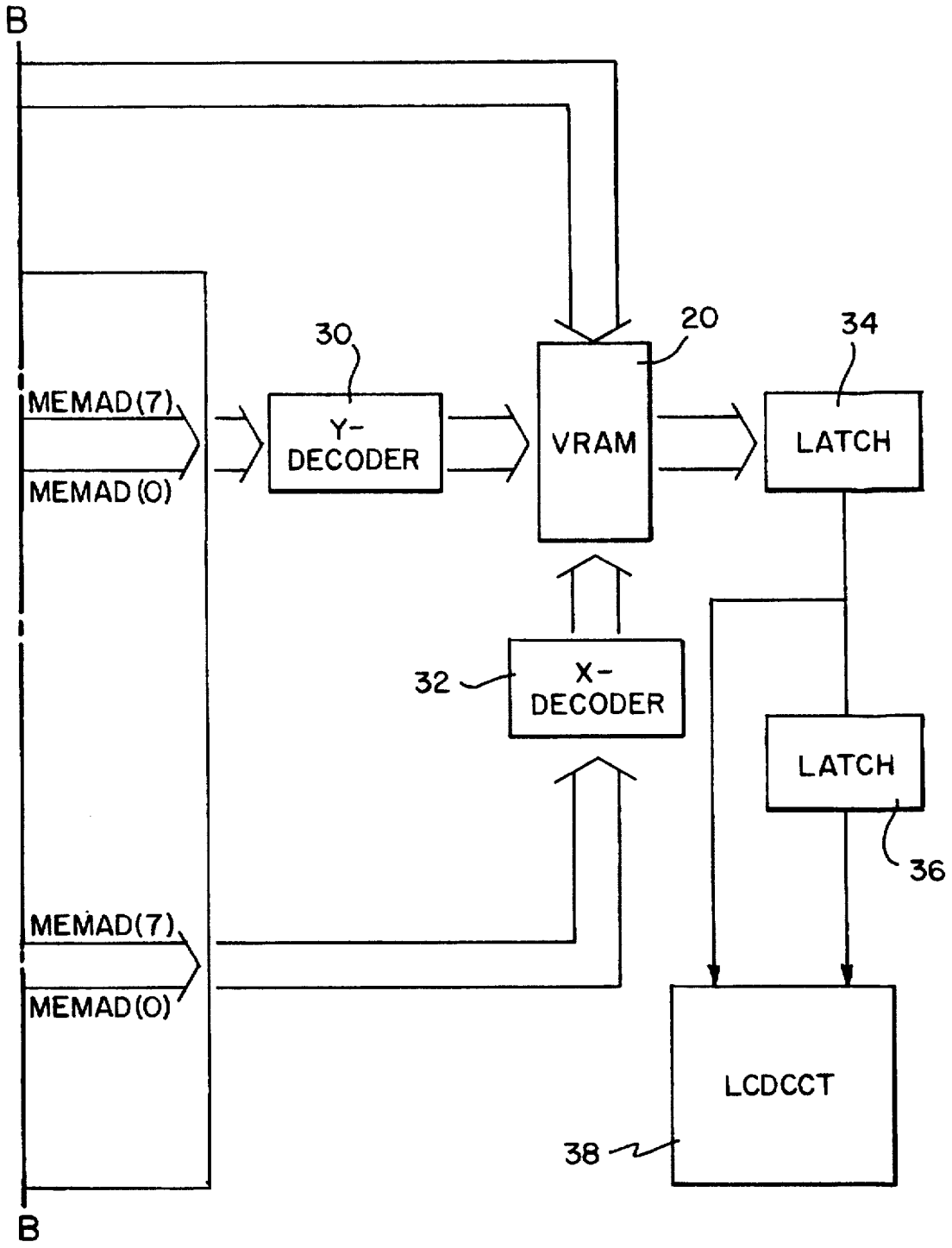

With referring to FIG. 1, a dot-matrix display apparatus 10 of this embodiment shown includes a CPU 12. A system address, that is, write address for writing display data which is outputted from a main memory 14 in a VRAM 20 is outputted from the CPU 12 so as to be applied to an address conversion/switch circuit 16.

In addition, a bus 18 which couples the CPU 12 and the main memory 14 to each other is used as an address bus and a data bus in a time-shared manner, and the system address is applied to the address conversion/switch circuit 16 through the bus 18 and the display data is applied to the VRAM 20 through the bus 18.

In the address conversion/switch circuit 16, according to an address conversion table that is indicated in the following table 1, bits SYSAD[17]-SYSAD[2] of system address of 16 bits, for example, are changed in position thereof.

TABLE 1

| | | |
|---|---|---|
| SYSAD[16] | MEMAD[7] | Y address |
| SYSAD[15] | MEMAD[6] | |
| SYSAD[14] | MEMAD[5] | |
| SYSAD[13] | MEMAD[4] | |
| SYSAD[12] | MEMAD[3] | |
| SYSAD[11] | MEMAD[2] | |
| SYSAD[10] | MEMAD[1] | |
| SYSAD[9] | MEMAD[0] | |
| SYSAD[8] | MEMAD[7] | X address |
| SYSAD[7] | MEMAD[6] | |
| SYSAD[6] | MEMAD[5] | |
| SYSAD[5] | MEMAD[4] | |
| SYSAD[4] | MEMAD[3] | |
| SYSAD[3] | MEMAD[2] | |
| SYSAD[2] | MEMAD[1] | |
| SYSAD[17] | MEMAD[0] | |

For example, in a case where a screen (not shown) of an LCD circuit 38 (described later) is divided into two screen portions vertically, the most significant bit of the system address, that is, SYSAD[17] is shifted to the least significant bit, and remaining bits of the system address, that is, SYSAD[2]-SYSAD[16] are shifted upward one by one bit.

More specifically, the system address is applied to multiplexers 26 and 28 (both will be described later) via address buses 17*a* and 17*b*, 17*c* and 17*d*; however, the most significant bit SYSAD[17] of the system address is applied to the least significant bit of the multiplexer 28 via the address bus 17*d*. Then, remaining bits SYSAD[2]-SYSAD[8] are shifted one by one bit by the address bus 17*a* and then applied to remaining bits of the multiplexer 28. The system address bit SYSAD[9] is applied to the least significant bit of the multiplexer 26 through the address bus 17*b*, and remaining bits SYSAD[10]-SYSAD[16] are shifted upward one by one bit by the address bus 17 and then applied to remaining bits of the multiplexer 26.

In addition, the system address is inputted as 18 bits, for example; however, in this embodiment shown, 16 bits in total from a 17th bit to a 2nd bit are used for an address for the VRAM 20.

The address conversion/switch circuit 16 performs address conversion in which upper 8 bits SYSAD[16]-SYSAD[9] of the system address obtained by the shifting are used as Y address bits MEMAD[7]-MEMAD[0] for designating a row of the VRAM and lower 8 bits SYSAD[8]-SYSAD[2] and SYSAD[17] of the system address thus obtained are used as X address bits MEMAD[7]-MEMAD[0] for designating a column of the VRAM 20. Thus, the X address and the Y address are respectively obtained.

Furthermore, to the address conversion/switch circuit 16, a display, that is, read address that is indicative of a display position and incremented by a counter 24 one by one row.

As described above, the address conversion/switch circuit 16 includes the multiplexers 26 and 28. In a normal state, each of the multiplexers 26 and 28 selects the CPU system address. That is, the upper 8 bits of the system and the lower 8 bits of the system address that are converted into the write address are selected by the multiplexers 26 and 28, respectively, and the upper 8 bits and the lower 8 bits are sent to a Y decoder 30 and an X decoder 32, respectively.

On the other hand, a request signal is applied from the display address generating circuit 22 to the multiplexers 26 and 28. Each of the multiplexers 26 and 28 selects the display address only when the request signal is applied thereto. That is, at that timing, the multiplexers 26 and 28 select upper 8 bits and lower 8 bits of the display address that is given by the display address generating circuit 22, and the upper 8 bits and the lower 8 bits of the display address are respectively sent to the Y decoder 30 and the X decoder 32.

In other words, if the request signal is applied to the multiplexers 26 and 28 from the display address generating circuit 22, an address to be selected is changed from the write address to the read address.

If the request signal from the display address generating circuit 22 is applied to the multiplexers 26 and 28 during an operation of a write mode, after completion of the write mode operation, an operation mode is changed into a read-out mode. In addition, as necessary, a mediation circuit for mediating conflict of a write request and a read request may be provided.

Then, the display read-out from the VRAM 20 one by one row in a bit-parallel fashion are temporarily latched by a latch 34, and therefore, the display data are outputted from the latch 34 one by one bit. Respective bits of the display data outputted from the latch 34 are inputted to the LCD circuit 38 directly or via a latch 36.

A specific example will be described. The CPU 12 outputs system addresses as indicated in the following table 2 in a manner that the system addresses are changed by one with starting at left upper of the VRAM 20 and completing at right lower of the VRAM 20. Such system addresses are converted into write addresses indicated in the following table 3 by the address conversion/switch circuit 16.

TABLE 2

| | Y address | X address |
|---|---|---|
| upper half screen 1st data ① | 00000000 | 00000000 |
| upper half screen 2nd data ③ | 00000000 | 00000001 |
| upper half screen 3rd data ⑤ | 00000000 | 00000010 |
| upper half screen 4th data ⑦ | 00000000 | 00000011 |
| upper half screen 5th data ⑨ | 00000000 | 00000100 |
| . | . | . |
| . | . | . |
| . | . | . |
| lower half screen 1st data ② | 10000000 | 00000000 |
| lower half screen 2nd data ④ | 10000000 | 00000001 |
| lower half screen 3rd data ⑥ | 10000000 | 00000010 |
| lower half screen 4th data ⑧ | 10000000 | 00000011 |
| lower half screen 5th data ⑩ | 10000000 | 00000100 |
| . | . | . |
| . | . | . |
| . | . | . |

TABLE 3

| | Y address | X address |
|---|---|---|
| upper half screen 1st data ① | 00000000 | 00000000 |
| lower half screen 1st data ② | 00000000 | 00000001 |
| upper half screen 2nd data ③ | 00000000 | 00000010 |
| lower half screen 2nd data ④ | 00000000 | 00000011 |
| upper half screen 3rd data ⑤ | 00000000 | 00000100 |
| lower half screen 3rd data ⑥ | 00000000 | 00000101 |
| upper half screen 4th data ⑦ | 00000000 | 00000110 |
| lower half screen 4th data ⑧ | 00000000 | 00000111 |
| upper half screen 5th data ⑨ | 00000000 | 00001000 |
| lower half screen 5th data ⑩ | 00000000 | 00001001 |
| . | . | . |
| . | . | . |
| . | . | . |

Figure 2:
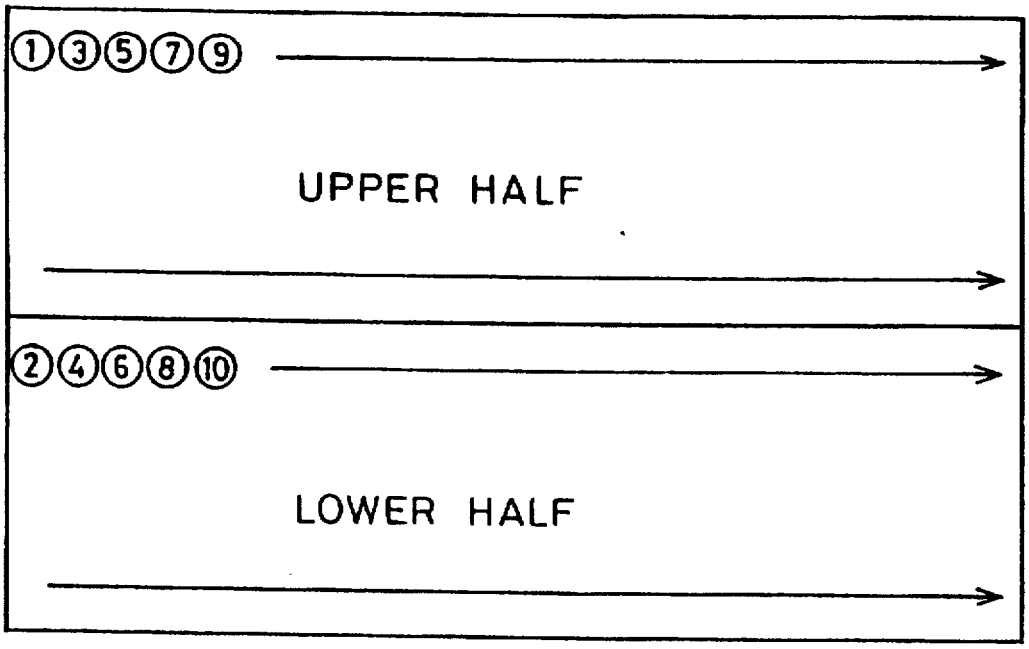
FIG. 2 is an illustrative view showing a system address space in a case where a screen is divided into two screen portions.

More specifically, the address conversion/switch circuit 16 outputs the upper 8 bits and the lower 8 bits as the Y address and the X address, respectively, in a state where the most significant bit of the system address is made as the least significant bit of the write address, and remaining bits of the system address is shifted upward one by one bit so as to become the remaining bits of the write address. Therefore, as shown in the table 3, the address for the upper half screen that has the least significant bit of "0" and the address for the lower half screen that has the least significant bit of "1" are generated one after the other. Therefore, as shown in FIG. 2, the display data for the upper half screen which are represented by odd numbers and the display data for lower half screen which are represented by even numbers are written in the VRAM 20 one after the other.

Figure 3:
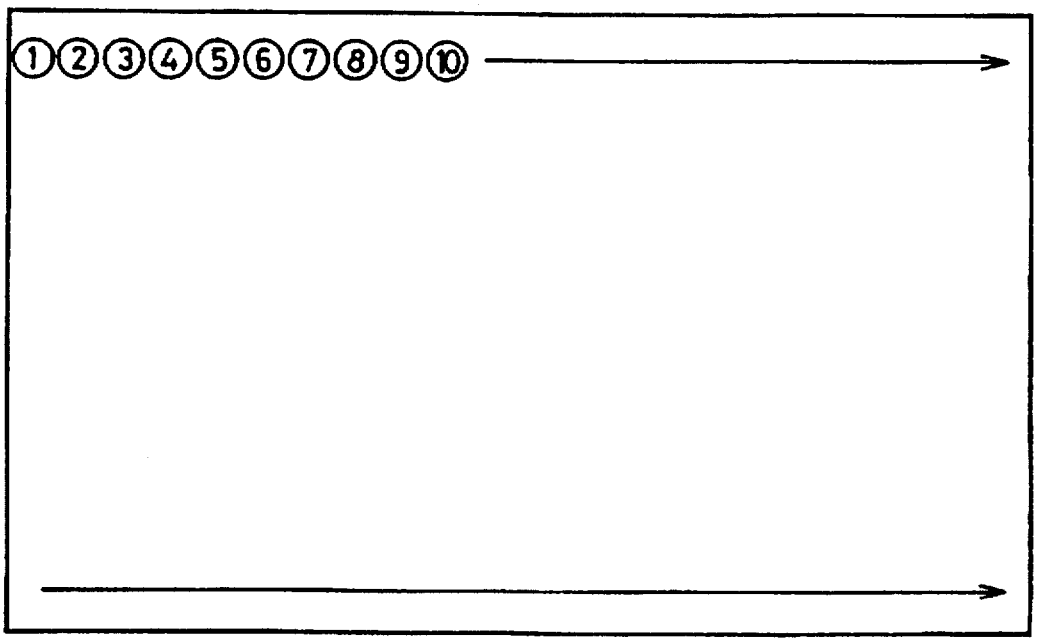
FIG. 3 is an illustrative view showing a display address space in the case of FIG. 2.

When the display data are read-out from the VRAM 20 in accordance with the display addresses which are incremented by the counter 24 (FIG. 1), as shown in FIG. 3, the display data are outputted in a bit-parallel fashion in a manner that the display data for the upper half screen and the display data for the lower half screen are alternately outputted. The display data are converted into bit-serial data by the latch 34 so as to be outputted sequentially one by one bit. The display data indicated by ① is further latched by the latch 36, and therefore, the display data of ① is inputted to the LCD circuit 38 at the same timing that the display data indicated by ② from the latch 34 is applied to the LCD circuit 38. Therefore, on the upper half screen and the lower half screen of the LCD circuit 38, images according to the display data of ① and ② are simultaneously displayed. In a similar manner, the display data of ③ and ④, the display data ⑤ and ⑥, the display data ⑦ and ⑧, . . . are simultaneously applied to the LCD circuit 38, respectively, and therefore, images according to such the display data are simultaneously displayed on the upper half screen and the lower half screen of the LCD circuit 38. Thus, as shown in FIG. 2, images are simultaneously displayed on the upper half screen and the lower half screen of the LCD circuit 38.

In addition, in the above described embodiment, the screen of the display is divided into two screen portions; however, such a dividing number is not limited to 2. In a case where the screen is divided into four screen portion, for example, the most significant 2 bits of the system address are changed to the least significant 2 bits of the write address and remaining bits are shifted upward for every 2 bits. Similarly, in a case where the screen is divided into 8 screen portions, the most significant 3 bits of the system address are made as the least significant 3 bits of the write address and remaining bits are shifted upward for every 3 bits. That is, when the screen is divided into $2^i$, the most significant i bits of the system address are changed to the least significant i bits of the write address and remaining bits of the system address are shifted upward for every i bits so as to become remaining bits of the write address. Thereafter, the Y address and the X address may be formed by an upper address and a lower address.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. Apparatus for generating display data for a dot-matrix display of $2^n$ rows in a horizontal direction and $2^m$ columns in a vertical direction comprising:

means for generating a system address having n+m bits, n and m each being an integer, means for converting a system address into write addresses such that the most significant one or more i bits of a system address of n+m bits are converted into the corresponding one or more least significant i bits of each of said write addresses, where i is an integer and $1 \leqq i \leqq n$, and the remaining bits of the system address are sequentially shifted upward in the direction of the most significant bit to become the remaining bits of the write address;

a display memory to which the display data is written according to Y write addresses for designating rows of the display memory and X write addresses for designating columns of the display memory, each of which Y and X write addresses are respectively formed by a respective one of the upper n bits and lower m bits of the write addresses which have been converted by said means for converting from system addresses; and means for generating read addresses each having n+m bits for reading out the display data written into said display memory in an address sequence order, a respective one of the upper n bits and lower m bits of said read addresses being for the Y addresses and the X addresses wherein images formed by the display data which are read from said display memory by said read addresses are simultaneously and respectively displayed on the same rows of screen portions formed by dividing a screen of said dot matrix display into $2^i$ screen portions arranged in only one of a horizontal direction or a vertical direction, where $1 \leqq i \leqq n$ for screen portions in the horizontal direction and $1 \leqq i \leqq m$ for screen portions in the vertical direction.

2. Apparatus according to claim 1, further comprising first switching means and second switching means, said first switching means selecting the upper n bits of the read address from the read address generating means or the upper n bits of the write address obtained by said means for converting, and said second switching means selecting the lower m bits of the read address from the read address generating means or the lower m bits of the write address obtained by said means for converting to control the write/read operations of said display memory.

3. Apparatus according to claim 2, further comprising first data holding means for performing a parallel-serial conversion of the display data output from said display memory and for outputting the display data one bit by one bit.

4. Apparatus according to claim 3, further comprising second data holding means for holding the display data from said first data holding means and applying the same to said dot-matrix display means at the same time when the display data is directly applied to said dot-matrix display means from said first data holding means.

5. Apparatus according to claim 1 wherein said dot matrix displaying means displays via the same row of each of said $2^i$ screen portions a different one of every $2^i$th bit of the display data read from said display memory for the images.

* * * * *

UNITED STATES PATENT AND TRADEMARK OFFICE

CERTIFICATE OF CORRECTION

PATENT NO. : 5,767,831

DATED : June 16, 1998

INVENTOR(S) : Kazumasa ONISHI et al.

It is certified that error appears in the above-indentified patent and that said Letters Patent is hereby corrected as shown below:

On the title page,

Item [73] should be corrected to read: Sanyo Electric Co., Ltd, Osaka, Japan and NEC Corporation, Tokyo, Japan.

Signed and Sealed this

Twenty-seventh Day of April, 1999

*Attest:*

Q. TODD DICKINSON

*Attesting Officer*

*Acting Commissioner of Patents and Trademarks*